United States Patent [19]

Allen

[11] 3,985,275

[45] Oct. 12, 1976

[54] CARRIER FOR SKIS AND SKI POLES

[75] Inventor: Richard Michael Allen, Provo, Utah

[73] Assignee: Electronic Chassis Corporation, Orem, Utah

[22] Filed: Apr. 21, 1975

[21] Appl. No.: 570,338

[52] U.S. Cl. ..... 224/45 S; 280/11.37 K; 70/58

[51] Int. Cl.[2] ..... B65D 71/00

[58] Field of Search ..... 224/45 S, 42.1 R; 211/60 SK; 70/58; 280/11.37 K, 11.37 A, 11.37 C

[56] References Cited

UNITED STATES PATENTS

| | | | |
|---|---|---|---|
| 3,114,487 | 12/1963 | Miller et al. | 224/45 S |
| 3,225,987 | 12/1965 | Bonner, Jr. | 224/45 S |
| 3,260,430 | 7/1966 | Sandenburgh | 224/45 S |
| 3,643,810 | 2/1972 | Highberger | 224/45 S |
| 3,753,359 | 8/1973 | Frey | 280/11.37 A |
| 3,754,420 | 8/1973 | Oellerich | 280/11.37 A |
| 3,780,920 | 12/1973 | Green | 224/45 S |
| 3,892,343 | 7/1975 | Warner | 224/45 S |

FOREIGN PATENTS OR APPLICATIONS

| | | | |
|---|---|---|---|
| 47,747 | 3/1919 | Sweden | 280/11.37 C |

*Primary Examiner*—L. J. Paperner
*Assistant Examiner*—Kenneth Noland
*Attorney, Agent, or Firm*—H. Ross Workman; J. Winslow Young

[57] ABSTRACT

A carrier for a pair of skis and a pair of ski poles wherein the ski poles serve as a handle for the carrier. The skis are received in hingedly joined channels, retainers in the hinged channels engage the ski poles. A locking bar is included and is keyed to bridge the channels to prevent the unauthorized removal of the skis and ski poles. A tether may be included with the locking bar for tethering the carrier to an object.

5 Claims, 2 Drawing Figures

CARRIER FOR SKIS AND SKI POLES

BACKGROUND

1. Field of the Invention

This invention relates to a carrier and securing device for a pair of skis and a pair of ski poles.

2. The Prior Art

The hand transport of a pair of skis and ski poles is a cumbersome and awkward task by reason of the size and number of objects to be carried. Additionally, with the recent increased emphasis upon skiing as a recreational sport, there has been a corresponding increase in the theft of ski equipment.

To preclude the theft of ski equipment, numerous devices have been developed which serve as securing devices for skis, for example, see U.S. Pat. Nos. 3,275,160; 2,999,378; 3,091,011; and 3,838,585. Each of these devices are directed in some manner toward securing a pair of skis and/or ski poles to an object. However, none of these devices disclose a carrier for skis and ski poles wherein the carrier is light weight, convenient and provides ready accessibility to the ski equipment while simultaneously providing a device for tethering the carrier to an object.

It would therefore be a desirable improvement in the art to provide a carrier for a pair of skis and ski poles which is compact, convenient, light weight, and securely engages a pair of skis and ski poles into a unitary package. The carrier should also provide for securing the skis and ski poles in the carrier while simultaneously providing a tether for tethering the carrier to an object. Such an improved carrier device is disclosed in the present invention.

BRIEF SUMMARY AND OBJECTS OF THE INVENTION

The present invention is a carrier for a pair of skis and a pair of ski poles wherein each ski is received into a lockable channel and the ski poles are engaged in the carrier whereby the ski poles advantageously serve as a handle for the carrier. A locking device restrains the skis in the channels and prevents removal of the ski poles. The locking device may further include a flexible tether for tethering the carrier to an object upon locking of the carrier. It is therefore an object of this invention to provide improvements in carriers for a pair of skis and a pair of ski poles.

It is another object of this invention to provide a unitary carrier for skis and ski poles.

An even still further object of this invention is to provide a carrier for skis and ski poles wherein the ski poles serve as the handle for the carrier.

An even still further object of this invention is to provide a device for locking the skis and the ski poles in the carrier.

One even still further object of this invention is to provide a tethering device for tethering the locked ski and ski pole carrier to an object.

These and other objects and features of the present invention will become more fully apparent from the following description and appended claims taken in conjunction with the accompanying drawing.

DETAILED DESCRIPTION OF THE PREFERRED EMBODIMENTS

Figure 1:
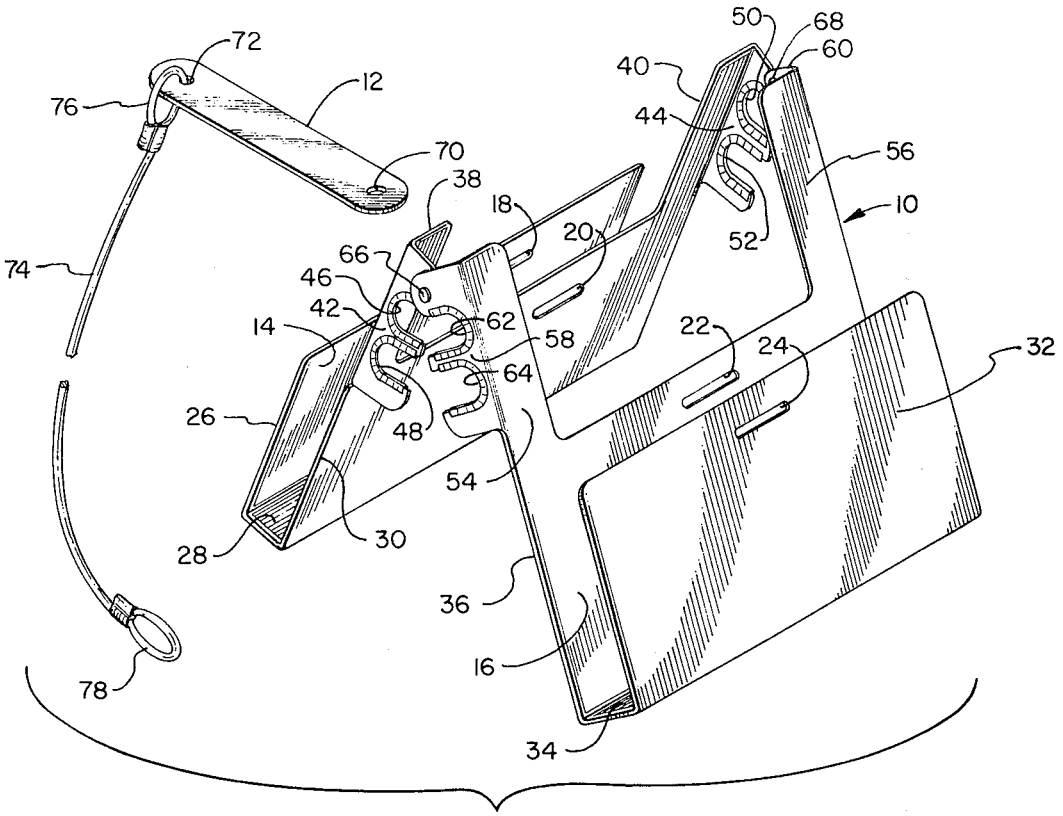
FIG. 1 is a schematic perspective view of the carrier of this invention shown in the partially opened position.

The invention is best understood by reference to the drawing wherein like parts are designated with like numerals throughout.

Referring now to the drawing, a carrier is shown generally at 10 and includes channels 14 and 16. Channel 14 includes a normally vertically extending outer wall 26, a flat bottom 28, and a vertically extending inner wall 30 defining a generally U-shaped vertically opening, ski-receiving slot, the function of which will be more fully discussed hereinafter. Vertically extending from inner wall 30 are two projecting extensions 38 and 40 the upper portion of each having an integral elongated tab thereon 42 and 44 bent normal to inner wall 30 and away from the opening of channel 14.

Tab 42 has at least two semicircular cutouts 46 and 48 therein which serve as one half of a ski pole receiving openings as will be discussed more fully hereinafter. Corresponding ski pole cutouts 50 and 52 are to be found in tab 44 and are aligned with cutouts 46 and 48, respectively.

A careful reference to channel 16 will reveal that channel 16 is substantially a mirror image of channel 14 and includes a normally vertically extending outer wall 32, a flat bottom 34 and a vertically extending inner wall 36 having projecting extensions 54 and 56. Projecting extensions 54 and 56 have tabs 58 and 60, respectively which are normal to the corresponding projections and are directed away from the channel 16. Tab 58 has ski pole cutouts 62 and 64 and tab 60 has correspondingly matched ski pole cutouts (hidden from view). Projecting extension 38 is hingedly joined with extension 54 at pin 66 between tab 42 and 58, respectively. Similarly, extension 40 is hingedly joined with extension 56 through pin 68 on tabs 44 and 60, respectively.

In a second preferred embodiment, the pivotal relationship between channels 14 and 16 may be selectively changed to a position at or near the bottom of the channels. Locking is provided in a manner similar to the first embodiment so as to secure the pair of skis and to engage the pair of ski poles in a position wherein the poles may serve as a handle for the carrier.

With each of the channels 14 and 16 hinged at pins 66 and 68, the opposed outward movement of channels 14 and 16 opens the corresponding cutouts as shown in FIG. 1. Each of the channels 14 and 16 is provided with aligned slots 18, 20 and 22, 24, respectively. In the closed position of FIG. 2, all four of the slots are aligned. A locking bar 12 is dimensionally sized to pass through all of the aligned slots 18, 20 and 22, 24, the bar 12 includes a lock receiving aperture 70 at one end and a tether receiving aperture 72 at the other end for receiving a tether 74. Tether 74 includes a loop 76 for securing the tether 74 to the aperture 72. A lock engaging loop 78 at the other end of the tether 74 may be used to anchor the carrier to a fixed object for security. Clearly, if the tether 74 is not used, a restraint must be secured to the end of the bar 12 near the aperture 72 to prevent passage through slots 18 and 20.

Figure 2:
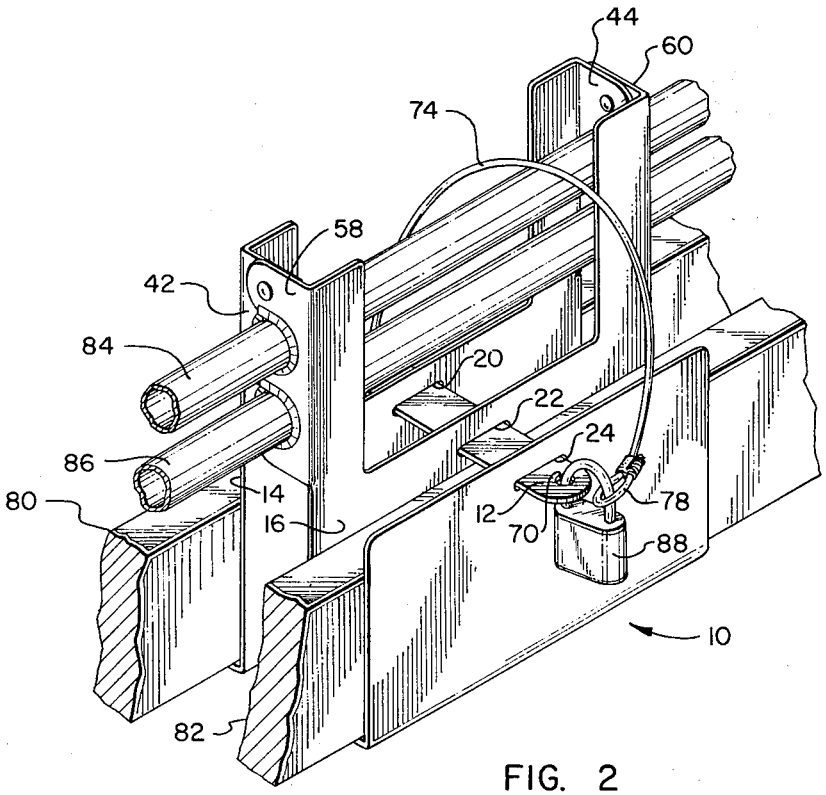
FIG. 2 is a schematic perspective view of the carrier of this invention having a pair of skis and a pair of ski poles engaged therein, portions of the skis and poles being broken away for ease of illustration.

Referring now more particularly to FIG. 2, the carrier 10 is shown in the carrying position with a ski 80 in channel 14 and a ski 82 in channel 16. Both skis are shown broken for ease of illustration. A pair of ski poles 84 and 86 (shown broken for sake of simplicity) are engaged in the respective coacting ski pole cutouts in each of corresponding angled tabs 42 and 58 at one end and angled tabs 44 and 60 at the other end, respectively, of the carrier 10.

Placement of locking bar 12 in slots 18 (FIG. 1) and 20 of channel 14 and 22 of channel 16 securely engage skis 80 and 82 in their respective channels and prevent the unauthorized removal therefrom. Slots 20 and 22 may selectively be eliminated by either lowering inner walls 30 and 36 or raising outer walls 28 and 38. It has been found that placement of locking bar 12 in slots 18 and 24 is sufficient to secure channel 14 to channel 16 in the foregoing manner. Locking bar 12 also prevents the opening of channel 14 away from channel 16 so as to prevent release of ski poles 84 and 86 from their respective engagement positions.

A lock 88 cooperates with aperture 70 to restrain locking bar 12 in its locking position and may also coact with loop 78 of tether 74 to thereby secure the tether 74 above an object (not shown) and immobilize carrier 10.

Importantly, when at least one of ski poles 84 and 86 are engaged in carrier 10 as shown in FIG. 2, the ski pole 84 and/or ski pole 86 cooperate with carrier 10 to serve as a handle portion for the same.

As presently configurated, the carrier 10 is particularly adapted to receive in the skis at a location between the front and rear bindings thereof thereby more securely engaging each ski in the respective channel of carrier 10.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A hand portable carrier for a pair of skis and a pair of ski poles, comprising:

channel means for receiving two skis in parallel relation the channel means comprising two separate ski receiving channels, each channel opening upwardly to receive a ski therein and each channel is pivotally joined to each other;

means connected to the end of each of said channel means for supporting the ski poles in parallel relation above the skis the support means being configurated with an opening through which the ski poles pass to accommodate at least one of the ski poles as a carrying handle for the carrier, said ski poles being selectively releasable from the support means; and means selectively locking both the skis in the channel means and the ski poles in the supporting means.

2. A hand portable ski carrier as defined in claim 1 wherein the locking means includes a tether for attaching the carrier to an object upon locking of the locking means.

3. A hand portable ski carrier as defined in claim 1 wherein the ski receiving means comprises a pair of hingedly joined, juxtaposed channels having the hinge at the upper end of the carrier, the channels opening upwardly on opposite sides of the carrier.

4. A unitary, hand portable carrier for a pair of skis and a pair of ski poles, comprising:

two parallel, upwardly-opening channels comprising a receiving channel for each ski, each channel having an upwardly directed projection at each end of the channel;

means pivotally joining the channels at each corresponding projection so that one channel can be arcuatey displaced relative to the next between an open and a closed position;

means integral with each projection for defining ski pole-receiving openings aligned to maintain ski poles essentially parallel to the longitudinal axis of the receiving channels, said ski pole-receiving openings being spaced above the channels sufficiently to permit hand grasping of the ski poles between the projections, said defining means (a) confining the ski poles when the channels are in the closed position and (b) discharging the ski poles when the channels are in the open position without discharging the skis from their respective channels; and locking means for obstructing the channels and securing the channels in the closed position to thereby secure the ski poles in the defining means.

5. A hand portable carrier for a pair of skis and a pair of ski poles as defined in claim 4 wherein the locking means includes a tether for attaching the carrier to an object when the locking means is locked in obstructing relationship across the channels.

* * * * *